US009070283B2

(12) United States Patent
Samuthirapandian et al.

(10) Patent No.: US 9,070,283 B2
(45) Date of Patent: Jun. 30, 2015

(54) FLIGHT DECK DISPLAY SYSTEMS AND METHODS FOR GENERATING IN-TRAIL PROCEDURE WINDOWS INCLUDING AIRCRAFT FLIGHT PATH SYMBOLOGY

(71) Applicant: HONEYWELL INTERNATIONAL INC., Morristown, NJ (US)

(72) Inventors: Subash Samuthirapandian, Tamilnadu (IN); Fazurudheen A, Tamilnadu (IN); Markus Johnson, Blue River, OR (US)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 211 days.

(21) Appl. No.: 13/752,782

(22) Filed: Jan. 29, 2013

(65) Prior Publication Data

US 2014/0210648 A1 Jul. 31, 2014

(51) Int. Cl.
*G08G 5/04* (2006.01)
*G08G 5/00* (2006.01)

(52) U.S. Cl.
CPC ..... *G08G 5/0008* (2013.01); *G08G 5/0021* (2013.01); *G08G 5/0078* (2013.01)

(58) Field of Classification Search
CPC .. G08G 5/0008; G08G 5/0078; G08G 5/0021
USPC ..... 340/961
See application file for complete search history.

(56) References Cited

U.S. PATENT DOCUMENTS 6,711,479 B1 3/2004 Staggs
7,570,178 B1 * 8/2009 Whalen et al. ..... 340/961
8,271,152 B2 9/2012 Singer et al.
2011/0066362 A1 3/2011 He
2011/0187588 A1 8/2011 Khatwa et al.
2011/0224847 A1 * 9/2011 Singer et al. ..... 701/4
2011/0276198 A1 11/2011 Khatwa et al.
2011/0316857 A1 12/2011 Pepitone et al.
2013/0245927 A1 * 9/2013 Kar et al. ..... 701/120

OTHER PUBLICATIONS

Project/Contract No: AST4-CT-2005-516140, ASSTAR, Advanced Safe Separation Technologies and Algorithms; Jan. 2, 2007.

Honeywell; Honeywell NextGen Traffic Collision Avoidance System Makes Flying Safer, Saves Airlines Millions in Fuel Costs, May 11, 2011; [http://honeywell.com/News/Pages/Honeywell-NextGen-Traffic-Collision-Avoidance-System].

* cited by examiner

*Primary Examiner* — Kerri McNally
(74) *Attorney, Agent, or Firm* — Ingrassia Fisher & Lorenz, P.C.

(57) ABSTRACT

Embodiments of a flight deck display system for deployment onboard a host aircraft are provided, as are embodiments of a method carried-out by a flight deck display system. In one embodiment, the flight deck display system includes a cockpit display, a wireless communication module, and a controller operatively coupled to the cockpit display and to the wireless communication module. The controller is configured to generate a vertical In-Trail Procedure (ITP) window on the cockpit display, which includes graphics representative of the current position of the host aircraft, the current position of an intruder aircraft when present within a predetermined distance of the host aircraft, and a plurality of flight levels. The controller is further configured to receive data from which the current flight path of the intruder aircraft can be derived; and periodically update the vertical ITP window to include flight path symbology indicative of the current flight path of the intruder aircraft.

18 Claims, 2 Drawing Sheets

FLIGHT DECK DISPLAY SYSTEMS AND METHODS FOR GENERATING IN-TRAIL PROCEDURE WINDOWS INCLUDING AIRCRAFT FLIGHT PATH SYMBOLOGY

TECHNICAL FIELD

The following disclosure relates generally to flight deck display systems and, more particularly, to embodiments of systems and methods for generating In-Trail Procedure windows including, for example, symbology representative of the flight path of the host aircraft and/or one or more intruder aircraft.

BACKGROUND

The flight level at which an aircraft flies can affect fuel consumption, emission rates, and other measures of aircraft performance. It is thus desirable to enable aircraft to frequently and freely transition flight levels as conditions, such as wind conditions and turbulence levels, vary at different flight levels. When an aircraft transitioning flight levels does so in the presence of nearby aircraft occupying an intervening flight level, the transition in flight level is commonly referred to as an "In-Trail Procedure" or, more simply, an "ITP." ITP protocols have been established to ensure safe and efficient transition in flight levels in the presence of aircraft traffic in non-radar regions, such as oceanic or remote airspace. Generally, under ITP protocols, the pilot or other aircrew members onboard an aircraft desiring to transition flight levels are required to ensure that a number of ITP criteria are satisfied before requesting clearance from an Air Traffic Controller ("ATC"). Such criteria may include the reception of qualified Automatic Dependent Surveillance Broadcast ("ADS-B") data from neighboring aircraft (commonly referred to as "reference aircraft") to ensure that minimum ITP separation requirements and maximum ground speed differential thresholds are not exceeded. The aircraft may then request clearance for the flight level change from the ATC. After confirming that a number of additional ITP criteria have been satisfied, such as the absence of nearby aircraft that could potentially block the ITP procedure, the ATC clears the aircraft for the change in flight level. The pilot of the aircraft then performs the ITP procedure without undue delay.

To assist in identifying and performing ITP maneuvers, flight deck display systems have been developed that generate a so-called "ITP window" on a cockpit display or monitor. The ITP window is typically a two-dimensional vertical representation of the airspace surrounding the aircraft equipped with the flight deck display system at issue (referred to herein as the "ownship aircraft" or the "host aircraft"). The ITP window may include symbology representative of the flight level occupied by the host aircraft, several flight levels above and below the flight level occupied by the host aircraft, and any neighboring aircraft (referred to herein as "intruder aircraft") within the vicinity of the host aircraft and meeting certain other criteria (e.g., aircraft traveling along a similar track as the host aircraft). By glancing at such an ITP window, a pilot can quickly form a mental picture of his or her surrounding environment and gain the information required to ensure a safe change in flight levels or, at minimum, to determine that a request to transition to a particular flight level is likely to be approved by the ATC. However, ITP windows generated by flight deck display systems remain limited in certain aspects. For example, and without implication that any such limitations have been recognized in the prior art, conventionally-generated ITP windows generally do not provide a pilot with readily comprehendible manner in which to predict future transitions in flight level by intruder aircraft and thereby determine in advance whether a transition to a soon-to-be-vacated flight level might be warranted.

It is therefore desirable to provide flight deck display systems and methods for generating ITP windows including symbology providing an enhanced situation awareness to a pilot and other aircrew members prior to and during an ITP event. It would be particularly desirable for such ITP window symbology to provide an intuitive and readily comprehendible visual queues as to the likely intent of intruder aircraft in transitioning or maintaining current flight levels, as well as to the current and future positioning of the host aircraft relative to nearby intruder aircraft during an ITP event. Other desirable features and characteristics of the present invention will become apparent from the subsequent Detailed Description and the appended Claims, taken in conjunction with the accompanying Drawings and the foregoing Background.

BRIEF SUMMARY

Embodiments of a flight deck display system for deployment onboard a host aircraft are provided. In one embodiment, the flight deck display system includes a cockpit display, a wireless communication module, and a controller operatively coupled to the cockpit display and to the wireless communication module. The controller is configured to generate a vertical ITP window on the cockpit display, which includes graphics representative of the current position of the host aircraft, the current position of an intruder aircraft when present within a predetermined distance of the host aircraft, and a plurality of flight levels. The controller is further configured to receive data from which the current flight path of the intruder aircraft can be derived; and periodically update the vertical ITP window to include flight path symbology indicative of the current flight path of the intruder aircraft.

Embodiment of a method carried-out by a flight deck display system onboard a host aircraft are further provided. The flight deck display system includes a cockpit display, a wireless communication module, and a processor operatively coupled to the cockpit display and to the wireless communication module. In one embodiment, the method includes generating a vertical ITP window on the cockpit display, the vertical ITP window including graphics representative of the position of the host aircraft, the position of an intruder aircraft, and a plurality of flight levels. ADS-B data is received from the intruder aircraft describing the current flight vector thereof, and the ADS-B data is provided to the controller. The vertical ITP window, as generated on the cockpit display by the controller, is subsequently updated to include flight path symbology comprising a line segment extending from the graphic representative of the current position of the intruder aircraft and forming an angle with a horizontal line indicating the current flight path of the intruder aircraft.

BRIEF DESCRIPTION OF THE DRAWINGS

At least one example of the present invention will hereinafter be described in conjunction with the following figures, wherein like numerals denote like elements, and.

Figure 1:
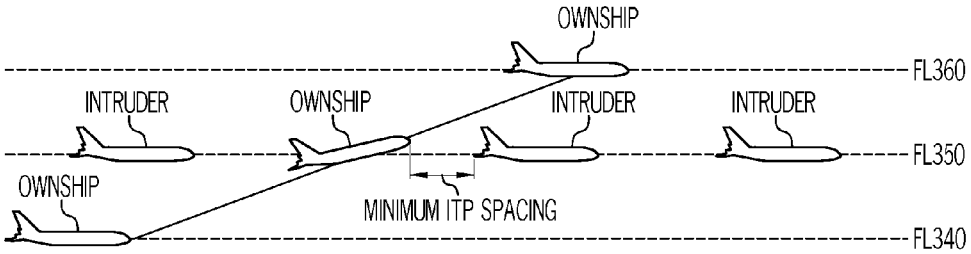
FIG. 1 is a diagram illustrating an exemplary and relatively simple ITP event performed by a host aircraft in the presence of an intruder aircraft.

For simplicity and clarity of illustration, the drawing figures illustrate the general manner of construction, and descriptions and details of well-known features and techniques may be omitted to avoid unnecessarily obscuring the invention. Additionally, elements in the drawings figures are not necessarily drawn to scale. For example, the dimensions of some of the elements or regions in the figures may be exaggerated relative to other elements or regions to help improve understanding of embodiments of the invention.

DETAILED DESCRIPTION

The following Detailed Description is merely exemplary in nature and is not intended to limit the invention or the application and uses of the invention. Furthermore, there is no intention to be bound by any theory presented in the preceding Background or the following Detailed Description. Terms such as "comprise," "include," "have," and variations thereof are utilized herein to denote non-exclusive inclusions. Such terms may thus be utilized in describing processes, articles, apparatuses, and the like that include one or more named steps or elements, but may further include additional unnamed steps or elements.

The term "pilot," as appearing herein, encompasses all members of a flight crew. The terms "host aircraft" or "ownship aircraft" are utilized to refer to an aircraft on which the below-described flight deck display system is deployed. The host aircraft can also be described as the "ITP aircraft" when in the process of requesting and performing an ITP maneuver. Neighboring aircraft within the proximity of the host aircraft are referred to herein as "intruder aircraft." Intruder aircraft may include ITP reference aircraft, which may transmit ADS-B data to the host aircraft during or prior to an ITP event. The term "Air Traffic Controller," and the corresponding acronym "ATC," generally refer to any control authority or authorities located remotely relative to the host or ownship aircraft and serving as recognized authorities in authorizing changes in flight level in accordance with pre-established ITP protocols, such as those described below. Finally, the term "ITP window," the term "vertical ITP window," and similar terms are defined broadly to include any virtual display or image contained within a graphical window or occupying the entire screen of a monitor or other cockpit display device, which visually conveys the ITP-related information set-forth in the following description and appended claims.

FIG. 1 is a vertical profile view illustrating an ITP event during which a host aircraft transition flight levels in the trail of a nearby intruder aircraft. In accordance with pre-established ITP protocols, the pilot of the host aircraft first requests clearance from an ATC to climb from an initial flight level (FL340) through an intervening occupied flight level (FL350) to a desired flight level (FL360). As indicated in FIG. 1, pre-established ITP criteria require minimum separation between aircraft at the current and requested flight levels to ensure a safe change in altitude. ITP protocols also specify various other criteria that must be satisfied before the host aircraft requests a flight level change. Although different criteria can be utilized, the following ITP initiation criteria can be utilized, where at least one of two conditions must be met: (i) if the ITP distance to the intruder aircraft is greater than or equal to a first predetermined distance threshold (e.g., 15 nautical miles), the groundspeed differential between the two aircraft is required to be less than or equal to a first groundspeed threshold (e.g., 20 knots); or (ii) if the ITP distance to an intruder aircraft is greater than or equal to a second predetermined distance threshold (e.g., 20 nautical miles), the groundspeed differential between the two aircraft is required to be less than or equal to a second predetermined groundspeed threshold (e.g., 30 knots).

Figure 2:
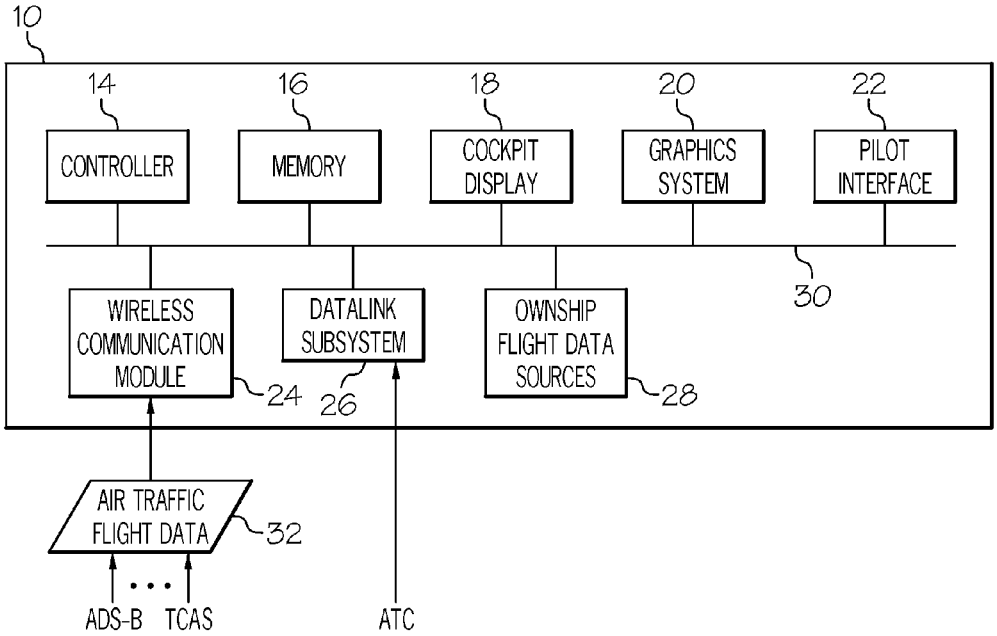
FIG. 2 is a block diagram of a flight deck display system deployed onboard a host aircraft and illustrated in accordance with an exemplary and non-limiting embodiment of the present invention.

To assist in identifying and performing ITP maneuvers, flight deck display systems have been developed that generate a so-called "ITP window" on a cockpit display or monitor. By way of non-limiting example, FIG. 2 sets-forth a block diagram of a Flight Deck ("FD") display system 10 suitable for generating an ITP window including certain enhanced symbology, as described more fully below in conjunction with FIG. 3. In the exemplary embodiment shown in FIG. 2, FD display system 10 includes the following components, many or all of which may be comprised of multiple devices, systems, or elements: a controller 14; memory 16; a graphics system 20; a pilot interface 22; a wireless communication module 24; a data link subsystem 26; and one or more sources of flight status data pertaining to the host aircraft (referred to herein as "ownship flight data sources 28"). The elements of FD display system 10 are operatively coupled together by an interconnection architecture 30 enabling the transmission of data, command signals, and operating power within FD display system 10. In practice, FD display system 10 and the host aircraft will typically include various other devices and components for providing additional functions and features, which are not shown in FIG. 2 and will not be described herein to avoid unnecessarily obscuring the invention. Although FD display system 10 is schematically illustrated in FIG. 2 as a single unit, the individual elements and components of FD display system 10 can be implemented in a distributed manner using any number of physically-distinct and operatively-interconnected pieces of hardware or equipment.

Controller 14 may comprise, or be associated with, any suitable number of additional conventional electronic components, including, but not limited to, various combinations of microprocessors, flight control computers, navigational equipment, memories, power supplies, storage devices, interface cards, and other standard components known in the art. Furthermore, controller 14 may include, or cooperate with, any number of software programs (e.g., avionics display programs) or instructions designed to carry out the various methods, process tasks, calculations, and control/display functions described below. As described in more detail below, controller 14 obtains and processes current flight status data (of the host aircraft and one or more intruder aircraft) to determine the ITP status windows for the host aircraft, and to control the rendering of the ITP window (e.g., ITP window 38 shown in FIG. 3) in an appropriate manner.

Memory 16 may be realized as RAM memory, flash memory, EPROM memory, EEPROM memory, registers, a hard disk, a removable disk, a CD-ROM, or any other form of storage medium known in the art. In this regard, memory 16 can be coupled to controller 14 such that controller 14 can read information from, and write information to, memory 16. In the alternative, memory 16 may be integral to controller 14. As an example, controller 14 and memory 16 may reside in an ASIC. In practice, a functional or logical module/component of FD display system 10 might be realized using program code that is maintained in the memory 16. For example, graphics system 20, wireless communication module 24, or the datalink subsystem 26 may have associated software program components that are stored in the memory 16. Moreover, memory 16 can be used to store data utilized to support the operation of FD display system 10, as will become apparent from the following description.

In an exemplary embodiment, cockpit display 18 is coupled to graphics system 20. Controller 14 and graphics system 20 cooperate to display, render, or otherwise convey one or more graphical representations, synthetic displays, graphical icons, visual symbology, or images associated with operation of the host aircraft on cockpit display 18, as described in greater detail below. An embodiment of FD display system 10 may utilize existing graphics processing techniques and technologies in conjunction with graphics system 20. For example, graphics system 20 may be suitably configured to support well known graphics technologies such as, without limitation, Video Graphics Array ("VGA"), super VGA, and ultra VGA technologies. Cockpit display 18 may comprise any image-generating device capable of producing one or more flight plan comparison pages of the type described below. A non-exhaustive list of display devices suitable for use as cockpit display 18 includes cathode ray tube, liquid crystal, active matrix, and plasma display devices. It will be appreciated that although FIG. 2 shows a single cockpit display 18, in practice, additional display devices may be present onboard the host aircraft.

Pilot interface 22 is suitably configured to receive input from a pilot or other crew member; and, in response thereto, to supply appropriate command signals to controller 14. Pilot interface 22 may be any one, or any combination, of various known pilot interface devices or technologies including, but not limited to: a touchscreen, a cursor control device such as a mouse, a trackball, or joystick; a keyboard; buttons; switches; or knobs. Moreover, pilot interface 22 may cooperate with cockpit display 18 and graphics system 20 to provide a graphical pilot interface. Thus, a crew member can manipulate pilot interface 22 by moving a cursor symbol rendered on cockpit display 18, and the user may use a keyboard to, among other things, input textual data. For example, the crew member could manipulate pilot interface 22 to enter a desired or requested new flight level into FD display system 10.

In an exemplary embodiment, wireless communication module 24 is suitably configured to support data communication between the host aircraft and one or more remote systems. More specifically, wireless communication module 24 allows reception of current air traffic data 32 of other aircraft within the proximity of the host aircraft. In particular embodiments, wireless communication module 24 is implemented as an aircraft-to-aircraft wireless communication module, which may include an S-mode transponder, that receives flight status data from an aircraft other than the host aircraft. For example, wireless communication module 24 may be configured for compatibility with ADS-B technology, with Traffic and Collision Avoidance System ("TCAS") technology, and/or with similar technologies.

Air traffic data 32 may include, without limitation: airspeed data; fuel consumption; groundspeed data; altitude data; attitude data, including pitch data and roll data; yaw data; geographic position data, such as GPS data; time/date information; heading information; weather information; flight path data; track data; radar altitude data; geometric altitude data; wind speed data; wind direction data; etc. FD display system 10 is suitably designed to process air traffic data 32 in the manner described in more detail herein. In particular, FD display system 10 can use air traffic data 32 when rendering the ITP window 38 (FIG. 3).

Datalink subsystem 26 enables wireless bi-directional communication between the host aircraft and an ATC. Datalink subsystem 26 may be used to provide ATC data to the host aircraft and/or to send information from the host aircraft to ATC in compliance with known standards and specifications. Using datalink subsystem 26, the host aircraft can send ITP requests to ground based ATC stations and equipment. In turn, the host aircraft can receive ITP clearance or authorization from ATC, as appropriate, such that the pilot can initiate the requested flight level change in the below-described manner.

In addition to performing the above-described functions, FD display system 10 is further configured to process the current flight status data for the host aircraft. The sources of ownship flight data 28 generate, measure, and/or provide different types of data related to the operational status of the host aircraft, the environment in which the host aircraft is operating, flight parameters, and the like. In practice, the sources of ownship flight data 28 may be realized using line replaceable units ("LRUs"), transducers, accelerometers, instruments, sensors, and other well-known devices. The sources of ownship flight data 28 may also be other systems, which, for the intent of this document, may be considered to be included within FD display system 10. Such systems may include, but are not limited to, a Flight Management System ("FMS"), an Inertial Reference System ("IRS"), and/or an Attitude Heading Reference System ("AHRS"). Data provided by the sources of ownship flight data 28 may include, without limitation: airspeed data; groundspeed data; altitude data; attitude data including pitch data and roll data; yaw data; geographic position data, such as Global Positioning System ("GPS") data; time/date information; heading information; weather information; flight path data; track data; radar altitude; geometric altitude data; wind speed data; wind direction data; fuel consumption; and the like. FD display system 10 is suitably designed to process data obtained from the sources of ownship flight data 28 in the manner described in more detail herein. In particular, FD display system 10 can utilize flight status data of the host aircraft when rendering the vertical ITP window 38 described below in conjunction with FIG. 3.

Figure 3:
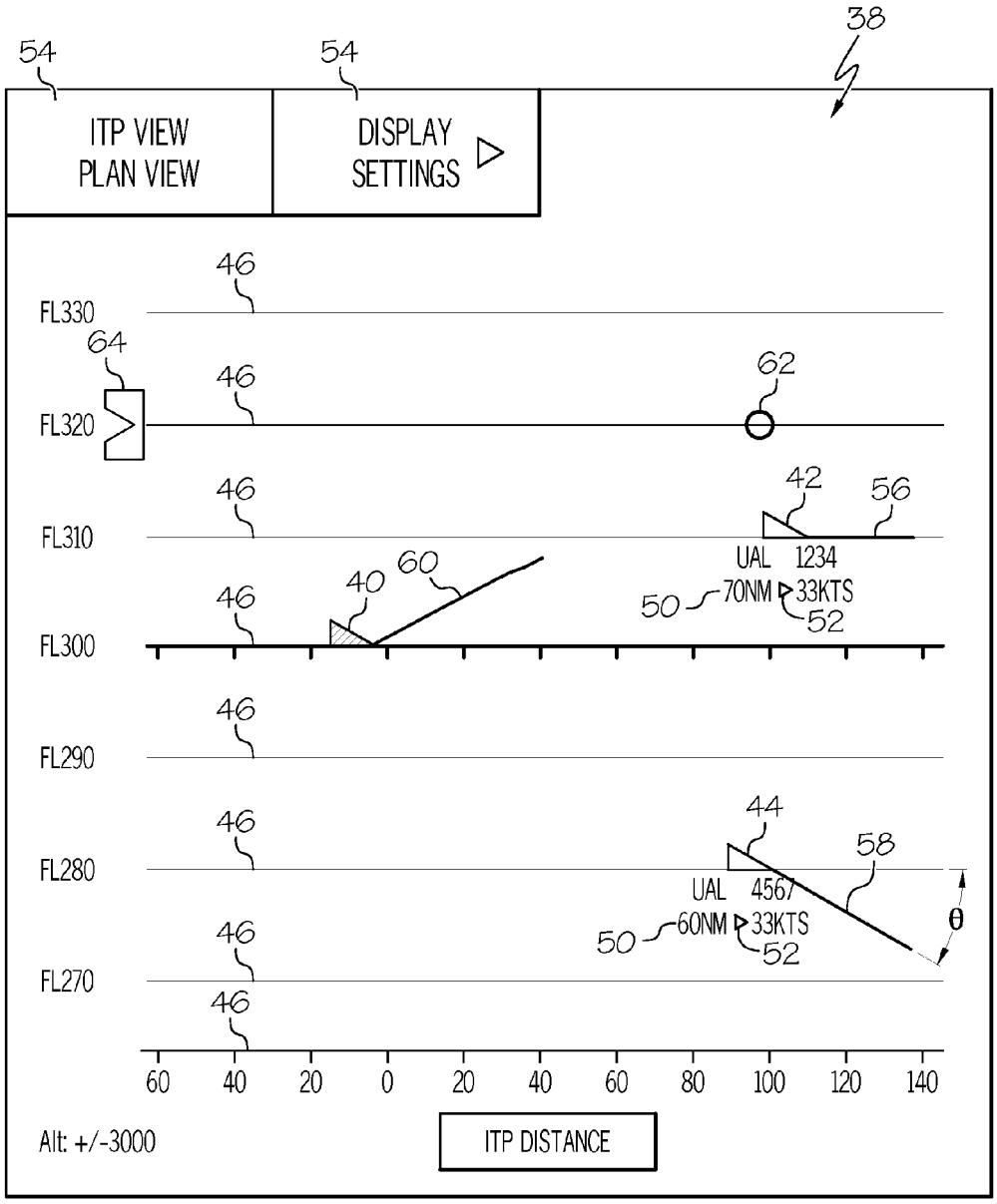
FIG. 3 is a screenshot of an ITP window, which may be generated by the flight deck display system shown in FIG. 2 and which includes symbology representative of the flight path of the host aircraft and intruder aircraft, as well as additional graphics useful in augmenting the situational awareness of a pilot prior to and during an ITP event.

Referring now to FIG. 3, there is shown an exemplary vertical ITP window 38 that may be generated on cockpit display 18 by controller 14 during operation of FD display system 10 (FIG. 2). As can be seen, ITP window 38 is generated to include a host aircraft symbol 40, which is indicative of the current detected position of the host aircraft and which is represented in FIG. 3 by a shaded or filled triangular icon. Similarly, ITP window 38 includes intruder aircraft symbols 42 and 44, which are indicative of the current detected or reported positions of intruder aircraft. In the illustrated example, intruder aircraft symbols 42 and 44 are drawn as non-filled triangular outlines. For ease of reference, the host aircraft represented by symbol 40 may be referred as "host aircraft 40" below; while the intruder aircraft represented by symbols 42 and 44 may be referred to as "intruder aircraft 42 and 44," respectively.

A plurality of vertically-spaced lines 46 are further generated on vertical ITP window 38 to represent the flight level currently occupied by the host aircraft (FL300 in the illustrated example), as well as several flight levels above and below the host aircraft-occupied flight level. In the exemplary scenario illustrated in FIG. 3, the first intruder aircraft, as represented by symbol 42, occupies a flight level above the host aircraft (FL310); while the second intruder aircraft, as represented by symbol 44, occupies a flight level below the host aircraft (FL280). The line 46 representative of the flight level occupied by the host aircraft (FL300) is drawn include horizontally-spaced markers corresponding to ITP distance axis 48, with a zero ITP distance corresponding to the current position of the host aircraft. The number of flight levels appearing on ITP window 38 will, of course, vary in conjunction with the scale in embodiments wherein the zoom level of ITP window 38 can be adjusted.

With continued reference to FIG. 3, additional graphics that may appear in ITP window 12 include, but are not limited to: textual information 50 identifying the flight number of the intruder aircraft; the distance between the host aircraft and the intruder aircraft in, for example, nautical miles; and/or the differential ground speed between the host aircraft and the intruder aircraft. As further indicated in FIG. 3, a triangular arrow symbol 52 may also be produced adjacent each intruder aircraft symbol 42 and 44 to indicate whether the distance separating the host aircraft from the intruder aircraft is increasing or decreasing. Various virtual controls or widgets (e.g., virtual buttons 54) may further be provided to, for example, enable a pilot to navigate from the ITP display to other displays (e.g., a top-down moving map display) and/or to change the appearance (e.g., color coding) of the symbology included within ITP window 38. In this manner, a pilot need only glance at ITP window 12 to determine the relative distance between the host aircraft (symbol 40) and the intruder aircraft (symbols 42 and 44) to determine whether the host aircraft is closing on any intruder aircraft. ITP window 12 thus provides the pilot with an enhanced situational awareness such that that the pilot is better informed as to the opportunities to change flight levels in accordance with ITP protocol.

To decrease display clutter and maximize overall visual clarity, vertical ITP window 38 will typically not include graphics representative of all surrounding air traffic present within the vicinity of the host aircraft at a given instance. Instead, ITP window 38 may typically only include graphical representation of neighboring aircraft within a predetermined distance of the host aircraft, which are ADS-B equipped and which are traveling in a similar direction as is the host aircraft. In certain embodiments, ITP window 38 may also include graphics representative of non-ADS-B equipped aircraft, the flight parameters of which may be reported to the host aircraft by an onboard TCAS system or other data sources.

In accordance with embodiments of the present invention, controller 14 generates vertical ITP window 38 to further include symbology representative of the current flight path or paths of any intruder aircraft appearing on ITP window 38 and/or the current flight path of the host aircraft. In the exemplary embodiment shown in FIG. 3, the flight paths of intruder aircraft 42 and 44 are represented by flight path symbols 56 and 58, respectively; while the flight path of the host aircraft is represented by flight path symbol 60. For clarity, flight path symbols 56, 58, and 60 are conveniently generated as line segments, which each extent from the graphic representative of the corresponding aircraft; i.e., flight path symbol 56 extends from the graphic representative of intruder aircraft 42, flight path symbol 58 extends from the graphic representative of intruder aircraft 44, and flight path symbol 60 extends from the graphic representative of host aircraft 40. As flight path symbols 56, 58, and 60 preferably assume the form of line segments, symbols 56, 58, and 60 will be referred to hereafter as "line segments 56, 58, and 60," respectively; it is emphasized, however, that flight path symbols 56, 58, and 60 may assume the form of any graphical element or elements that visually convey the trajectory of the host aircraft or an intruder aircraft on ITP window 38 shown in FIG. 3 or other ITP display.

Line segments 56, 58, and 60 may be drawn as solid, continuous, or unbroken line segments, as shown in FIG. 3. Alternatively, line segments 56, 58, and 60 may be generated as dashed line segments, dotted line segments, or a combination of dashed-and-dotted line segments. Line segments 56, 58, and 60 may be generated to have a substantially identical or disparate appearances. For example, line segments 56 and 58 (representative of the intruder aircraft flight paths) may be generated to have a different appearance as compared to line segment 60 (representative of the host aircraft flight path); e.g., line segments 56 and 58 may be drawn as dashed, while line segment 60 is drawn as solid or unbroken. Of course, disparate color coding may also be utilized to distinguish between line segments 56, 58, and 60, as desired. Such differences in appearance may be selectable or may be preprogrammed in accordance with customer preferences. In alternative embodiments, ITP window 12 may include flight path symbology for only the host aircraft and/or any nearby intruder aircraft.

Line segments 56 and 58 thus provide a pilot with an intuitive visual representative of the flight paths of intruder aircraft 42 and 44, respectively; and, therefore, an indication of the future intent of aircraft 42 and 44. For example, and with continued reference to FIG. 3, line segment 56 is substantially horizontal; that is, forms an angle of ~0 with a horizontal line. This indicates that intruder aircraft 42 is flying at a substantially level altitude and, therefore, not in the process of transitioning fight levels. Thus, by referring to ITP window 38, the pilot of host aircraft 40 can quickly ascertain that the flight level occupied by intruder aircraft 42 (FL310) will continue to be occupied by aircraft 42 for the time being. Conversely, line segment 56 forms an angle with a horizontal line that has a non-zero value (labeled in FIG. 3 as angle $\theta$). This indicates that intruder aircraft 44 is either climbing or descending and, therefore, may be in the process of transitioning flight levels. In the illustrated example, specifically, $\theta$ is negative such that line segment 58 has a downward component (as taken relative to the current position of intruder aircraft 44) indicating that intruder aircraft 44 is currently descending. The magnitude of $\theta$ indicates the rate which intruder aircraft 44 is ascending or descending. Thus, by glancing at ITP window 38, a pilot can determined that intruder aircraft 44 is descending at a relatively rapid rate and, therefore, likely to be in the process of transitioning to a lower flight level. This provides the pilot of host aircraft 40 with the opportunity to monitor whether intruder aircraft 44 will, in fact, vacate its current flight level (FL280); and, if so, to plan in advance whether it would be advantageous to occupy the soon-to-be-vacated flight level. Controller 14 may periodically update ITP window 38 at a predetermined refresh rate of, for example, one half second.

To further direct the attention of a pilot to an intruder aircraft likely in the process of transitioning flight levels, the appearance of flight path symbol for the intruder aircraft may be altered when the angle formed by the intruder aircraft flight path and a horizontal line exceeds a threshold value. For example, with reference to FIG. 3, the appearance of line segment 58 may be changed (e.g., line segment 58 may become thicker, may be highlighted, may change color, may flash, etc.) when the absolute value of $\theta$ exceeds a threshold value to indicate that intruder aircraft 44 is descending or ascending at an appreciable rate and, therefore, may likely be in the process of changing flight levels. The appearance of line segments 56, 58, and 60 may also be changed if the rate at which intruder aircraft 42, intruder aircraft 44, or host aircraft 40, respectively, exceeds a maximum altitude change rate established by the ITP protocol. The length of line segments 56, 58, and 60 may be fixed; or, instead, may be variable to indicate changes in a speed (e.g., the ground speed) of the intruder aircraft 42, intruder aircraft 44, or host aircraft 40, respectively. Notably, line segments 56, 58, and 60 are preferably truncated (i.e., do not extend across ITP window 12) to minimize display clutter.

FD display system 10 (FIG. 2), and specifically controller 14, can determine the flight path of any nearby intruder aircraft utilizing data received from any one of a number of sources. However, in preferred embodiments wherein wireless communication module 24 (FIG. 2) includes an ADS-B receiver, position and direction of nearby ADS-B equipped intruder aircraft is transmitted to wireless communication module 24 by the intruder aircraft and/or by the other ADS-B equipped aircraft (commonly referred to as "reference aircraft"). The position and direction of the intruder aircraft may be derived from vector information contained within the ADS-B data. While this is preferred, in embodiments wherein ADS-B data including vector information is not transmitted, or in embodiments wherein it is desired to check the accuracy of the vector information contained with the ADS-B data for redundancy, controller 14 may also calculate the predicted flight path of intruder aircraft based, at least in part, on position data and speed data for at least two time intervals. As indicated in FIG. 2, such information may be contained within, for example, TCAS data communicated to wireless communication module 24. The flight path information for host aircraft 40 can be determined from onboard sensors and systems generically identified in FIG. 2 as ownship flight data sources 28. As previously indicated, such data sources 28 may include an FMS, an IRS, and/or an AHRS deployed onboard the host aircraft.

In addition to flight paths symbols for host aircraft 40 and/or intruder aircraft 42 and 44, ITP window 38 may also be generated to include at least one symbol indicative of the flight level intercept point at which host aircraft 40 is predicted to reach a flight level during a flight level change. With continued reference to FIG. 3, this symbol may assume the form of a marker 62 (e.g., a circular marker) intersecting the vertically-spaced line representative of a new flight level to which the host aircraft 40 has been cleared to transition. By referring to flight level intercept point marker 62, along with host aircraft flight path symbol 60, a pilot can quickly determine the intercept point for an intended flight level transition and the separation between the intercept point and neighboring aircraft, such as intruder aircraft 42. FD display system 10 may also be configured to generate a warning on vertical ITP window 38 if the distance between the flight level intercept point and time-projected position of the intruder aircraft is less than a predetermined threshold value. Such a warning may be graphical (e.g., red color coding, flashing, or other change in the appearance marker 62), textual, and/or audible.

FD display system 10, and specifically controller 14, may generate flight level intercept point marker 62 on ITP window 12 in the following manner. First, after requesting and receiving clearance from an ATC to transition to a new flight level, the pilot enters the flight level to which host aircraft 40 will transition utilizing, for example, pilot interface 22. In response to reception of this pilot input, controller 14 may identify the new flight level by color coding (e.g., the destination flight level, which is FL320 in FIG. 3, may be color coded green or another color depending upon the particular color coding scheme implemented) and/or by producing a selection symbol 64 adjacent the line 46 representative of the destination flight level. Substantially concomitantly, controller 14 may calculate the predicted flight level intercept point based upon the entered destination flight level and the current flight path of the host aircraft and then generate marker 62 on ITP window 12 in the appropriate position.

There has thus been provided flight deck display systems and methods for generating ITP windows including symbology providing an enhanced situation awareness to a pilot and other aircrew members prior to and during a transition in flight level, as carried-out in accordance with ITP criteria. In preferred embodiments of the above-described flight deck display system and method, the ITP window was generated to include symbology providing intuitive and readily comprehendible indication as to the likely intent of neighboring or intruder aircraft in transition or maintaining current flight levels, as well as the positioning of the host aircraft relative to intruder during a transition in flight level.

Although an exemplary embodiment of the present invention has been described above in the context of a fully-functioning computer system (i.e., flight deck display system 10 described above in conjunction with FIG. 2), those skilled in the art will recognize that the mechanisms of the present invention are capable of being distributed as a program product (i.e., an avionics display program) and, furthermore, that the teachings of the present invention apply to the program product regardless of the particular type of computer-readable media (e.g., floppy disc, hard drive, memory card, optical disc, etc.) employed to carry-out its distribution. In certain implementations, the flight deck display system may comprise graphical user interface (e.g., ARINC 661) components, which may include a user application definition file ("UADF"). As will be appreciated by one skilled in the art, such a UADF is loaded into the flight deck display system and defines the "look and feel" of the display, the menu structure hierarchy, and various other static components of the ITP window or display.

While at least one exemplary embodiment has been presented in the foregoing Detailed Description, it should be appreciated that a vast number of variations exist. It should also be appreciated that the exemplary embodiment or exemplary embodiments are only examples, and are not intended to limit the scope, applicability, or configuration of the invention in any way. Rather, the foregoing Detailed Description will provide those skilled in the art with a convenient road map for implementing an exemplary embodiment of the invention. Various changes may be made in the function and arrangement of elements described in an exemplary embodiment without departing from the scope of the invention as set-forth in the appended Claims.

What is claimed is:

1. A flight deck display system for deployment onboard a host aircraft, the flight deck display system comprising:

a cockpit display;

a wireless communication module; and a controller operatively coupled to the cockpit display and to the wireless communication module, the controller configured to:

generate a vertical In-Trail Procedure (ITP) window on the cockpit display, the vertical ITP window including graphics representative of the current position of the host aircraft, the current position of an intruder aircraft when present within a predetermined distance of the host aircraft, and a plurality of flight levels;

receive via the wireless communication module data from which the current flight path of the intruder aircraft can be derived;

periodically update the vertical ITP window to include flight path symbology indicative of the current flight path of the intruder aircraft;

predict whether the intruder aircraft is transitioning from its current flight level to a new flight level based, at least in part, on the current position of the intruder aircraft and the flight path thereof; and if the intruder aircraft is predicted to be in the process of transitioning flight levels, generating graphics on the vertical ITP window identifying the current flight level of the intruder aircraft as likely to become available.

2. The flight deck display system of claim 1 wherein the controller is configured to receive via the wireless communication module Automatic Dependent Surveillance Broadcast (ADS-B) data from the intruder aircraft describing the current flight vector thereof.

3. The flight deck display system of claim 1 wherein the controller is configured to:

receive, via the wireless communication module, the current speed and position of intruder aircraft; and project the current flight path of the intruder aircraft based, at least in part, of the current speed and position of the intruder aircraft.

4. The flight deck display system of claim 3 wherein the controller is configured to extract the current speed and altitude of the intruder aircraft from Traffic Collision Avoidance System (TCAS) data received via the wireless communication module.

5. The flight deck display system of claim 1 further comprising a pilot interface operatively coupled to the controller, the controller further configured to receive pilot input via the pilot interface selecting a new flight level cleared for the host aircraft to occupy.

6. The flight deck display system of claim 5 wherein the controller is further configured to generate graphics on the vertical ITP window identifying the new flight level cleared for the host aircraft to occupy.

7. The flight deck display system of claim 5 wherein the controller is further configured to:

estimate the flight level intercept point at which the host aircraft will enter the new flight level based, at least in part, on the current position of the host aircraft and the flight path thereof; and generate on the vertical ITP window a symbol identifying the flight level intercept point.

8. The flight deck display system of claim 7 wherein the graphics representative of the plurality of flight levels comprise a plurality of vertically-spaced lines each representative of a different flight level, and wherein the symbol identifying the flight level intercept point comprise a marker intersecting the vertically-spaced line representative of the newly-cleared flight level.

9. The flight deck display system of claim 7 wherein the controller is further configured to generate a warning on the vertical ITP window if the distance between the flight level intercept point and an intruder aircraft is less than a predetermined threshold value.

10. The flight deck display system of claim 1 wherein the flight path symbology indicative of the current flight path of the intruder aircraft comprises a line segment extending from the graphic representative of the current position of the intruder aircraft.

11. The flight deck display system of claim 10 wherein the controller is further configured to periodically update the vertical ITP window, while varying the length of the line segment as a function of changes in the air speed of the intruder aircraft.

12. The flight deck display system of claim 10 wherein the line segment has a fixed length.

13. The flight deck display system of claim 10 wherein the controller is further configured to alter the appearance of the line segment when the absolute angle formed by the line segment with a horizontal line exceeds a threshold value to indicate a potential transition in flight level by the intruder aircraft.

14. The flight deck display system of claim 1 wherein the controller is configured to:

receive data describing the current flight path of the host aircraft; and periodically update the vertical ITP window to include flight path symbology indicative of the current flight path of the host aircraft.

15. The flight deck display system of claim 14 wherein the flight deck display system further comprises an onboard sensor system selected from the consisting of a Flight Management System, an Inertial Reference System, and an Attitude Heading Reference System; and wherein the controller is configured to receive data describing the current flight path of the host aircraft from the onboard sensor system.

16. A method carried-out by a flight deck display system onboard a host aircraft, the flight deck display system including a cockpit display, a wireless communication module, and a processor operatively coupled to the cockpit display and to the wireless communication module, the method comprising:

generating a vertical In-Trail Procedure (ITP) window on the cockpit display, the vertical ITP window including graphics representative of the position of the host aircraft, the position of an intruder aircraft, and a plurality of flight levels;

receiving via the wireless communication module Automatic Dependent Surveillance Broadcast (ADS-B) data from the intruder aircraft describing the current flight vector thereof;

providing the ADS-B data indicative of the current flight path of the intruder aircraft to the controller; and updating the vertical ITP window, as generated on the cockpit display by the controller, to include flight path symbology comprising a line segment extending from the graphic representative of the current position of the intruder aircraft and forming an angle with a horizontal line indicating the current flight path of the intruder aircraft.

17. A flight deck display system for deployment onboard a host aircraft, the flight deck display system comprising:

a cockpit display;

a pilot interface;

a wireless communication module; and a controller operatively coupled to the cockpit display, to the wireless communication module, and to the pilot interface, the controller configured to:

generate a vertical In-Trail Procedure (ITP) window on the cockpit display, the vertical ITP window including graphics representative of the current position of the host aircraft, the current position of an intruder aircraft when present within a predetermined distance of the host aircraft, and a plurality of flight levels;

receive pilot input via the pilot interface selecting a new flight level cleared for the host aircraft to occupy;

receive via the wireless communication module data from which the current flight path of the intruder aircraft can be derived;

periodically update the vertical ITP window to include flight path symbology indicative of the current flight path of the intruder aircraft;

estimate the flight level intercept point at which the host aircraft will enter the new flight level based, at least in part, on the current position of the host aircraft and the flight path thereof;

generate on the vertical ITP window a symbol identifying the flight level intercept point; and generate a warning on the vertical ITP window if the distance between the flight level intercept point and an intruder aircraft is less than a predetermined threshold value.

18. A flight deck display system for deployment onboard a host aircraft, the flight deck display system comprising:

a cockpit display;

a wireless communication module; and a controller operatively coupled to the cockpit display and to the wireless communication module, the controller configured to:

generate a vertical In-Trail Procedure (ITP) window on the cockpit display, the vertical ITP window including graphics representative of the current position of the host aircraft, the current position of an intruder aircraft when present within a predetermined distance of the host aircraft, and a plurality of flight levels;

receive via the wireless communication module data from which the current flight path of the intruder aircraft can be derived;

periodically update the vertical ITP window to include flight path symbology indicative of the current flight path of the intruder aircraft and comprising a line segment extending from the graphic representative of the current position of the intruder aircraft; and periodically update the vertical ITP window, while varying the length of the line segment as a function of changes in the air speed of the intruder aircraft.

* * * * *